US011472688B2

(12) United States Patent
Hou

(10) Patent No.: US 11,472,688 B2
(45) Date of Patent: Oct. 18, 2022

(54) WATER OUTPUT DEVICE

(71) Applicant: Xiamen Aquasu Electric Shower Co., Ltd., Xiamen (CN)

(72) Inventor: Quanduo Hou, Xiamen (CN)

( * ) Notice: Subject to any disclaimer, the term of this patent is extended or adjusted under 35 U.S.C. 154(b) by 0 days.

(21) Appl. No.: 17/224,150

(22) Filed: Apr. 7, 2021

(65) Prior Publication Data

US 2021/0323804 A1 Oct. 21, 2021

(30) Foreign Application Priority Data

Apr. 17, 2020 (EP) ..... 20170213

(51) Int. Cl.

| | |
|---|---|
| ***B67D 1/00*** | (2006.01) |
| ***B67D 1/08*** | (2006.01) |
| ***F25D 31/00*** | (2006.01) |
| *B67D 1/10* | (2006.01) |

(52) U.S. Cl.

CPC ..... *B67D 1/0009* (2013.01); *B67D 1/0858* (2013.01); *F25D 31/003* (2013.01); *B67D 1/0071* (2013.01); *B67D 1/10* (2013.01); *B67D 2210/0001* (2013.01)

(58) Field of Classification Search

CPC .. B67D 1/0009; B67D 1/0858; B67D 1/0071; B67D 1/10; B67D 2210/0001; F25D 31/003

See application file for complete search history.

(56) References Cited

U.S. PATENT DOCUMENTS

| | | | | |
|---|---|---|---|---|
| 6,319,414 | B1 * | 11/2001 | Wiseburgh | B67D 1/04 210/739 |
| 6,375,048 | B1 * | 4/2002 | van der Meer | B67D 1/0878 222/396 |
| 2006/0060606 | A1 * | 3/2006 | Jablonski | B67D 1/0057 222/129.1 |
| 2018/0344074 | A1 * | 12/2018 | Dussault | A47J 31/467 |

FOREIGN PATENT DOCUMENTS

| | | | | |
|---|---|---|---|---|
| CN | 108272346 A | * | 7/2018 | A47J 31/41 |
| CN | 110870692 A | * | 3/2020 | A47J 31/00 |
| KR | 2015016158 A | * | 2/2015 | F25D 11/00 |

* cited by examiner

*Primary Examiner* — Frederick C Nicolas

(57) ABSTRACT

A water output device is provided. The water output device comprises a housing mechanism; a water purification mechanism, which comprises a water purifier located within the housing mechanism; a refrigeration mechanism, which comprises a compressor located within the housing mechanism; a tank assembly, which comprises a first tank mechanism configured for providing hot water, and second tank mechanism configured for providing ice water and soda water; the first tank mechanism comprises a hot water tank in communication with the water purifier; the second tank mechanism comprises a ice water tank in communication with the water purifier, a soda water tank located within the ice water tank, a water pump in communication with the ice water tank and the soda water tank respectively, and a cooling pipe spirally extended into the ice water tank.

7 Claims, 10 Drawing Sheets

WATER OUTPUT DEVICE

CROSS-REFERENCE OF RELATED APPLICATIONS

The present application claims the benefit of European Patent Application No. 20170213.1, entitled "WATER OUTPUT DEVICE" filed on Apr. 17, 2020, in the European Patent Office, the entire content of which is incorporated herein in its entirety.

TECHNICAL FIELD

The disclosure relates to the technical field of water output equipment, and more particularly to a novel water output device.

BACKGROUND

With the development of science and technology, people have more and more requirements for water output device, including hot water dispenser, pure water dispenser, ice water dispenser, and soda water dispenser.

In the prior art, due to the volume limitation, the water output device generally does not have water tanks for ice water and soda water, respectively. In most cases, the water tank is either filled with ice water or soda. When the water tank is filled with ice water, the soda water is obtained by exchanging the ice water. When the water tank is filled with soda water, the ice water is obtained by exchanging the soda water. However, this cannot obtain pure ice water or soda water, which sometimes may bring inconvenient to the users.

SUMMARY OF THIS INVENTION

The present disclosure provides a water output device, which aims to solve the technical in the prior art and improve user experience in using the water output device.

The provided water output device comprises:

a housing mechanism;

a water purification mechanism, which comprises a water purifier located within the housing mechanism;

a refrigeration mechanism, which comprises a compressor located within the housing mechanism;

a tank assembly, which comprises a first tank mechanism configured for providing hot water, and second tank mechanism configured for providing ice water and soda water; the first tank mechanism comprises a hot water tank in communication with the water purifier; the second tank mechanism comprises a ice water tank in communication with the water purifier, a soda water tank located within the ice water tank, a water pump in communication with the ice water tank and the soda water tank respectively, and a cooling pipe spirally extended into the ice water tank; wherein the cooling pipe is connected to the compressor; the ice water tank comprises an air inlet pipeline for passing carbon dioxide gas; the hot water tank, the ice water tank, and the soda water tank comprises water output pipelines, respectively;

the water pump is configured for drawing the water from the ice water tank into the soda water tank.

In some embodiments, the water output device at least comprises a heat dissipation mechanism for cooling the refrigeration mechanism; the heat dissipation mechanism comprises a fan, a condenser, and a heat exhaust pipe; the fan is facing the refrigeration mechanism, and is attached to a side surface of the housing mechanism; the heat exhaust pipe faces the fan and leads to a bottom surface of the fan an leads to a bottom surface of the housing mechanism.

In some embodiments, the water tank assembly comprises a seat, and a heat insulation element with 8-shaped located within the seat; the hot water tank and the ice water tank are arranged within the seat, respectively, and located in the heat insulation element.

In some embodiments, the seat is a two-piece structure which can be disassembled.

In some embodiments, the cooling pipe is spirally wound around the soda water tank.

In some embodiments, the first tank mechanism comprises an expansion valve in communication with the hot water tank; the second tank mechanism comprises a safety valve in communication with the soda water tank.

In some embodiments, the air inlet pipeline comprises a first balancing valve, and the water output pipeline comprises a second balancing valve.

In some embodiments, the water output device comprises a first solenoid valve arranged at an inlet end of the water purifier, a second solenoid valve arranged between the water purifier and the hot water tank, a third solenoid valve arranged between the water purifier and the ice water tank, a fourth solenoid valve arranged on the water output pipeline of the ice water tank, and a fifth solenoid valve arranged on the water output pipeline of the soda water tank.

By the embodiments described, the present disclosure has the following advantages.

The water output device can provide the hot water, ice water and soda water in one single device with the size of the device being effectively controlled. More specifically, the ice water tank and the hot water tank in the present disclosure are independent of each other while the soda water tank is located within the ice water tank, therefore the size of the device can be effectively controlled. Additionally, the ice water tank, hot water tank and the soda water tank are separate tanks, and users are able to obtain pure ice water or pure soda water. Additionally, when the refrigeration mechanism is cooling the water within the ice water tank, the soda water tank can be cooled at the same. This is an improvement for energy use.

BRIEF DESCRIPTION OF THE DRAWINGS

In order to specify the embodiments of the present disclosure, the accompanying drawings used in the embodiments will be briefly introduced below. It should be understood that the following drawings only show some embodiments of the present disclosure, and therefore should not be regarded as a limit on the scope of this disclosure. For those with ordinary skill in the art, equivalent drawings can be obtained based on these drawings without creative work.

Figure 1:
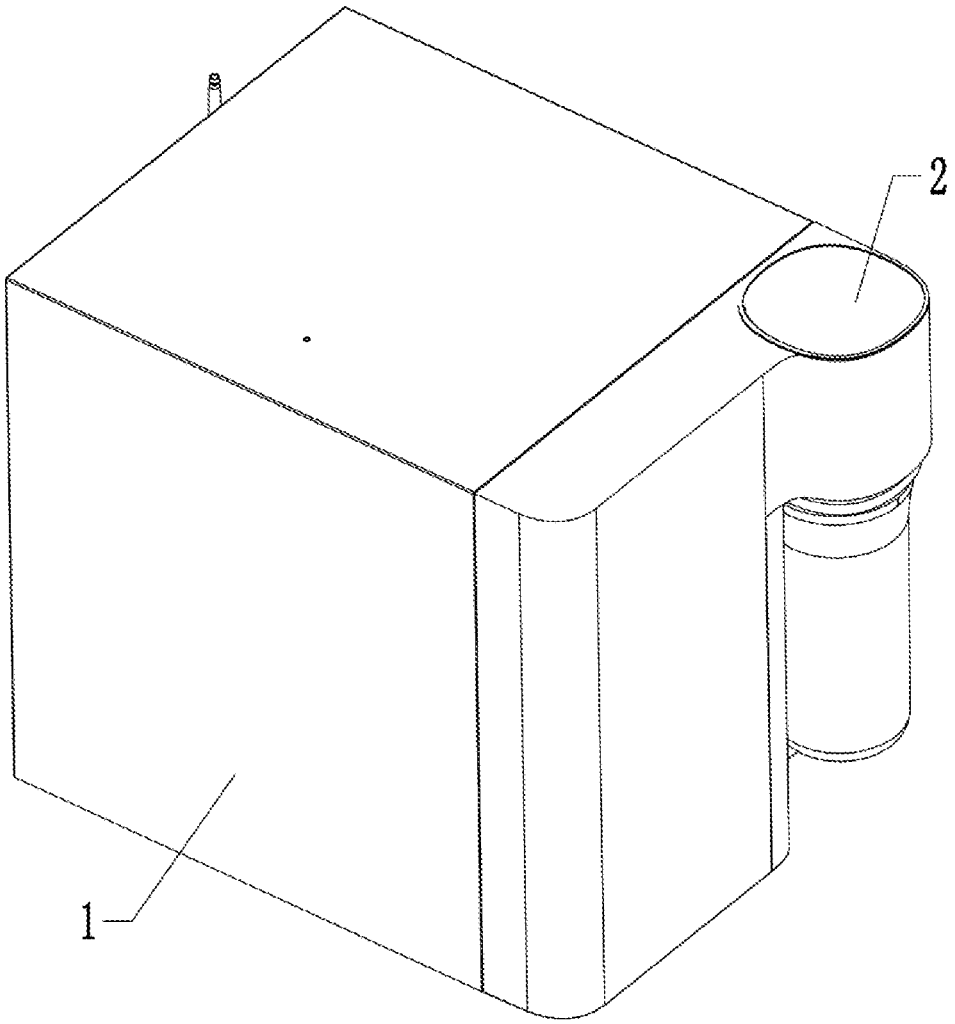
FIG. 1 is a schematic diagram of the water output device according to one embodiment of the present disclosure.
Figure 2:
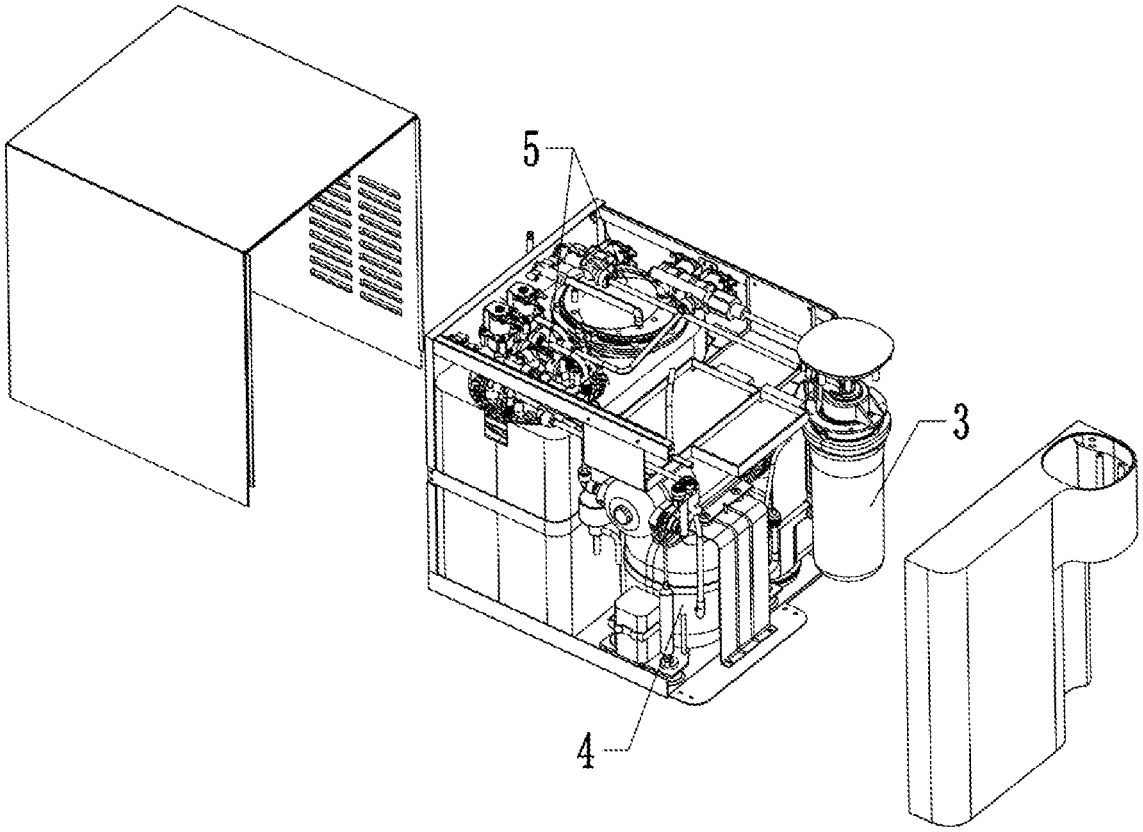
FIG. 2 is a partial exploded diagram of the water output device according to one embodiment of the present disclosure.

Character references in the drawings: 1, housing mechanism; 2, control mechanism; 3, water purification mechanism; 4, refrigeration mechanism; 5, water tank assembly; 6, water pump; 7, first solenoid valve; 8, second solenoid valve; 9, third solenoid valve; 10, fourth solenoid valve; 11, fifth solenoid valve; 12, heat dissipation mechanism; 13, fan; 14, condenser; 15, heat exhaust pipe; 16, seat; 17, first tank mechanism; 18, second tank mechanism; 19, heat insulation element; 20, cooling pipe; 21, ice water tank; 22, soda water tank; 23, flow sensor; 24, water purifier; 25, hot water tank; 26, expansion valve; 27, first balancing valve; 28, second balancing valve; 29, safety valve.

DETAILED DESCRIPTION OF THE DISCLOSURE

As shown in FIGS. 1-3 and 10, in the present embodiment, a water output device is provided. The provided water output device comprises a housing mechanism 1, a water purification mechanism 3, a refrigeration mechanism 4, a tank assembly 5.

The water purification mechanism 3 comprises a water purifier 24 located within the housing mechanism 1.

The refrigeration mechanism 4 comprises a compressor located within the housing mechanism 1.

Further referring to FIGS. 6-10, the water assembly 5 comprises a first tank mechanism 17 configured for providing hot water, and second tank mechanism 18 configured for providing ice water and soda water. The first tank mechanism 17 comprises a hot water tank 25 in communication with the water purifier 24. The second tank mechanism 18 comprises a ice water tank 21 in communication with the water purifier 24, a soda water tank 22 located within the ice water tank 21, a water pump 6 in communication with the ice water tank 21 and the soda water tank 22 respectively, and a cooling pipe 20 spirally extended into the ice water tank 21. The cooling pipe 20 is connected to the compressor. Additionally, it is to be noted that the water pump 6 is configured for drawing water from the ice water tank 21 into the soda water tank 22. The ice water tank 21 comprises an air inlet pipeline for passing carbon dioxide gas. The hot water tank 25, the ice water tank 21, and the soda water tank 22 comprises water output pipelines, respectively.

Figure 9:
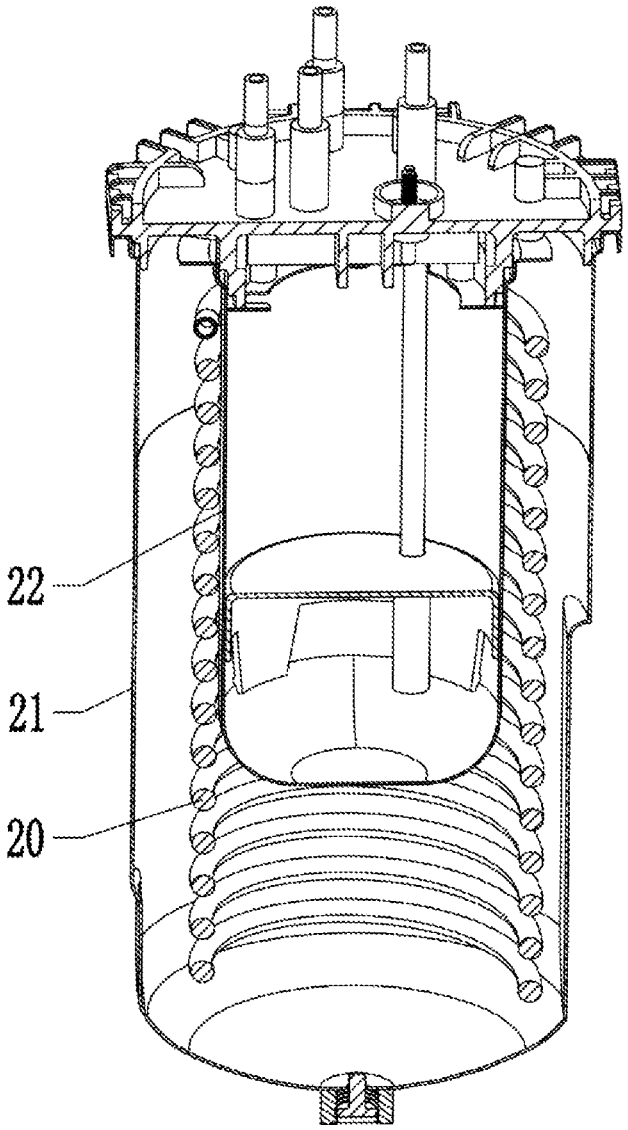
FIG. 9 is a cross-sectional diagram of the second tank mechanism according to one embodiment of the present disclosure.

Furthermore, as shown in FIG. 9, the cooling pipe 20 is spirally wound around the soda water tank 22. During use, the compressor cools the water within the ice water tank 21 by the cooling pipe 20. At the same time, since the soda water tank 22 is located within the ice water tank 21 and the cooling pipe 20 is spirally wound around the soda water tank 22, the water tank assembly 5 in the present disclosure has smaller size, and the ice water tank 21 and the soda water tank can be cooled synchronously. This can be an improvement for energy use. In most embodiments, the water outputted from the ice water tank 21 and the soda water tank 22 is 4° C. in general.

Figure 6:
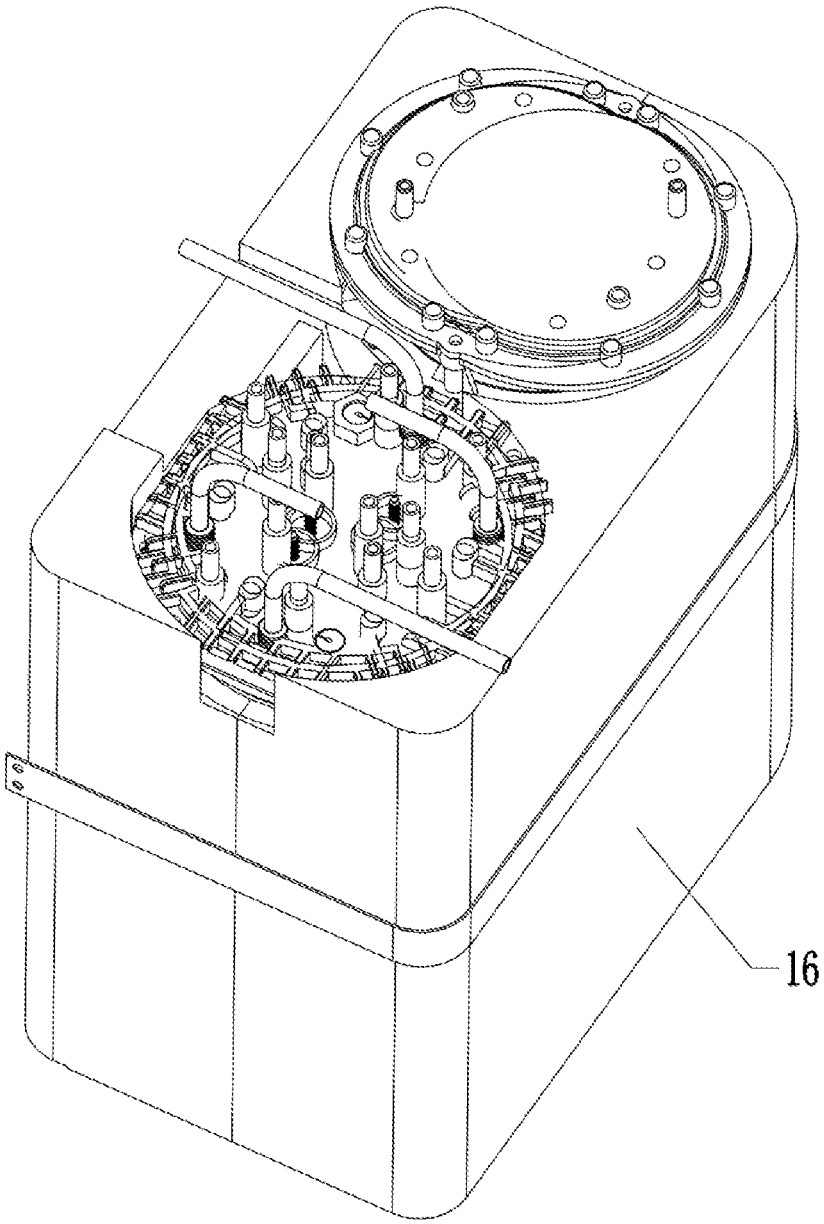
FIG. 6 is a schematic diagram of the water tank assembly according to one embodiment of the present disclosure.
Figure 7:
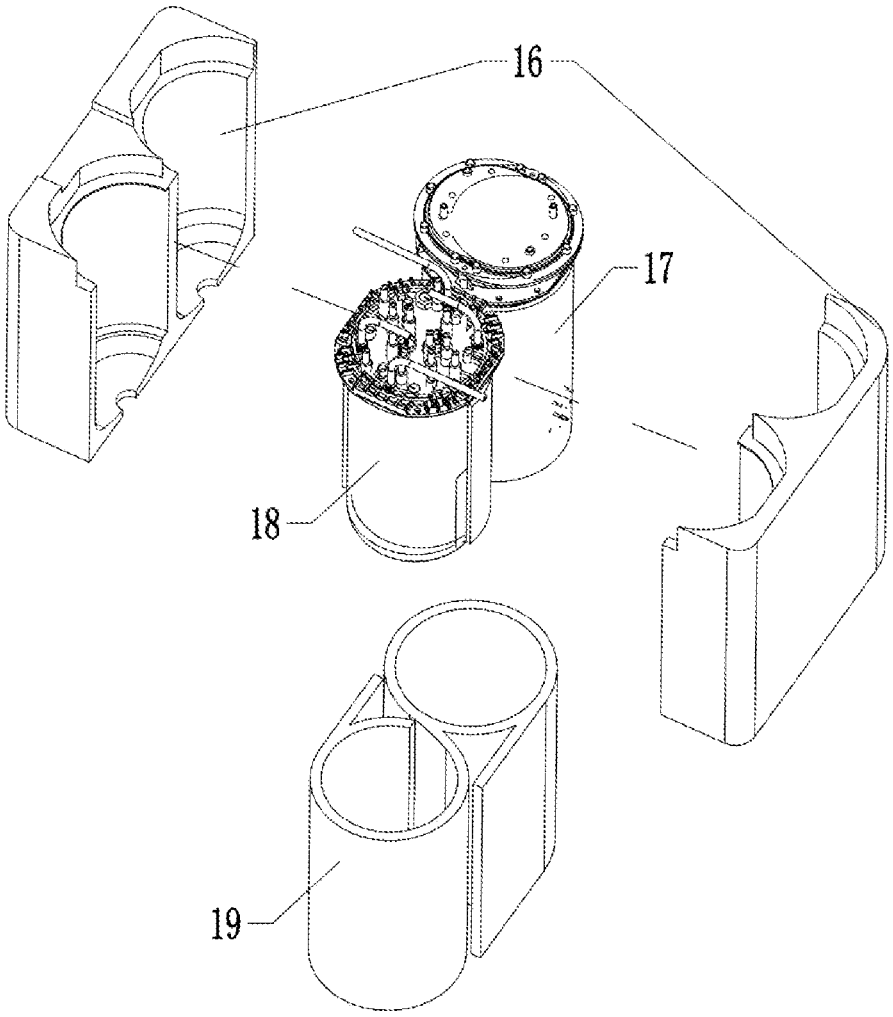
FIG. 7 is a partial exploded diagram of the water tank assembly according to one embodiment of the present disclosure.
Figure 8:
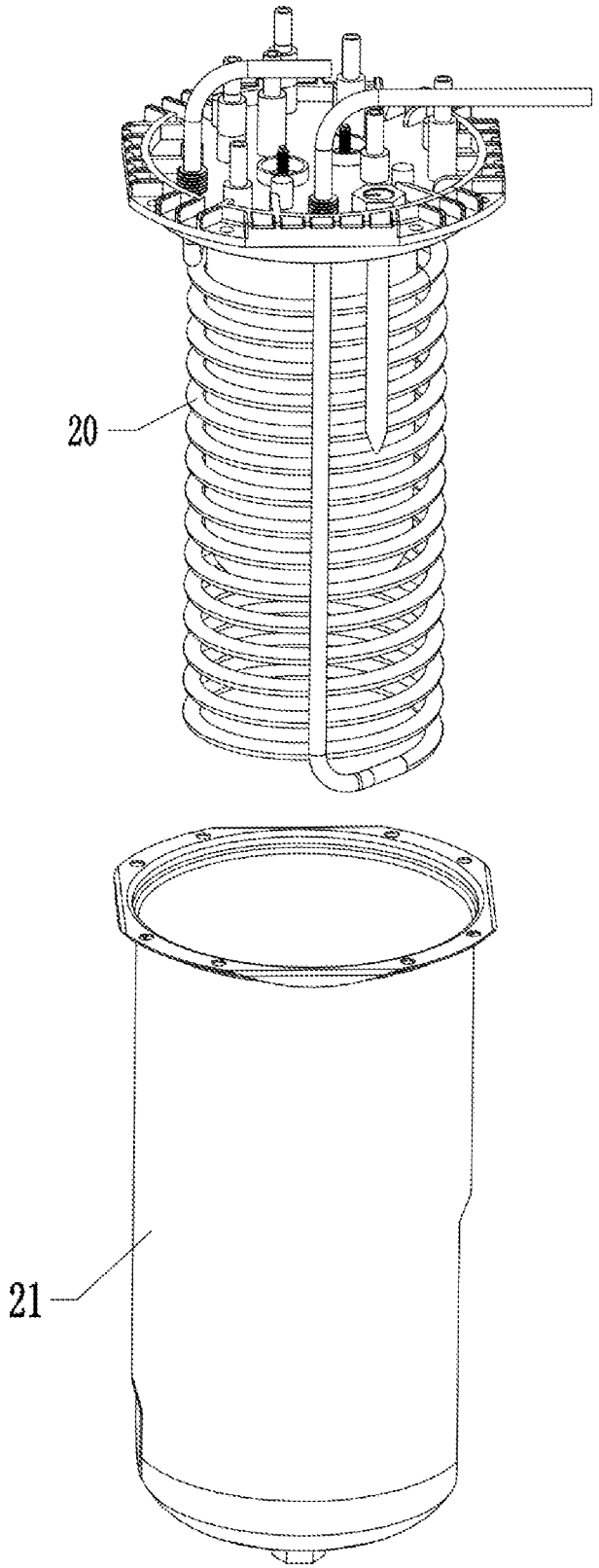
FIG. 8 is a partial exploded diagram of the second tank mechanism according to one embodiment of the present disclosure.

As shown in FIGS. 6-7, the water tank assembly 5 comprise a seat 16, and a heat insulation element 19 which is 8-shaped. The hot water tank 25 and the ice water tank 21 are located within the seat 16, respectively, and fitted into the heat insulation element 19. The seat 16 is a two-piece structure which is disassembled. Cavities are arranged in the seat for receiving the first tank mechanism 17 and the second tank mechanism 18. Obviously, the first tank mechanism 17 and the second tank mechanism 18 is sleeved with heat insulation element 19, so the temperature of the hot water tank 25 and the ice water tank can be preserved. In this embodiment, the heat insulation element 19 is an 8-shaped structure. The 8-shaped structure can wrap the first tank mechanism 17 and the second tank mechanism 18 at the same time, and facilitate the production of the heat insulation element 19. Additionally, the heat insulation element 19 can be made of PU or the like which can preserve temperature.

Figure 4:
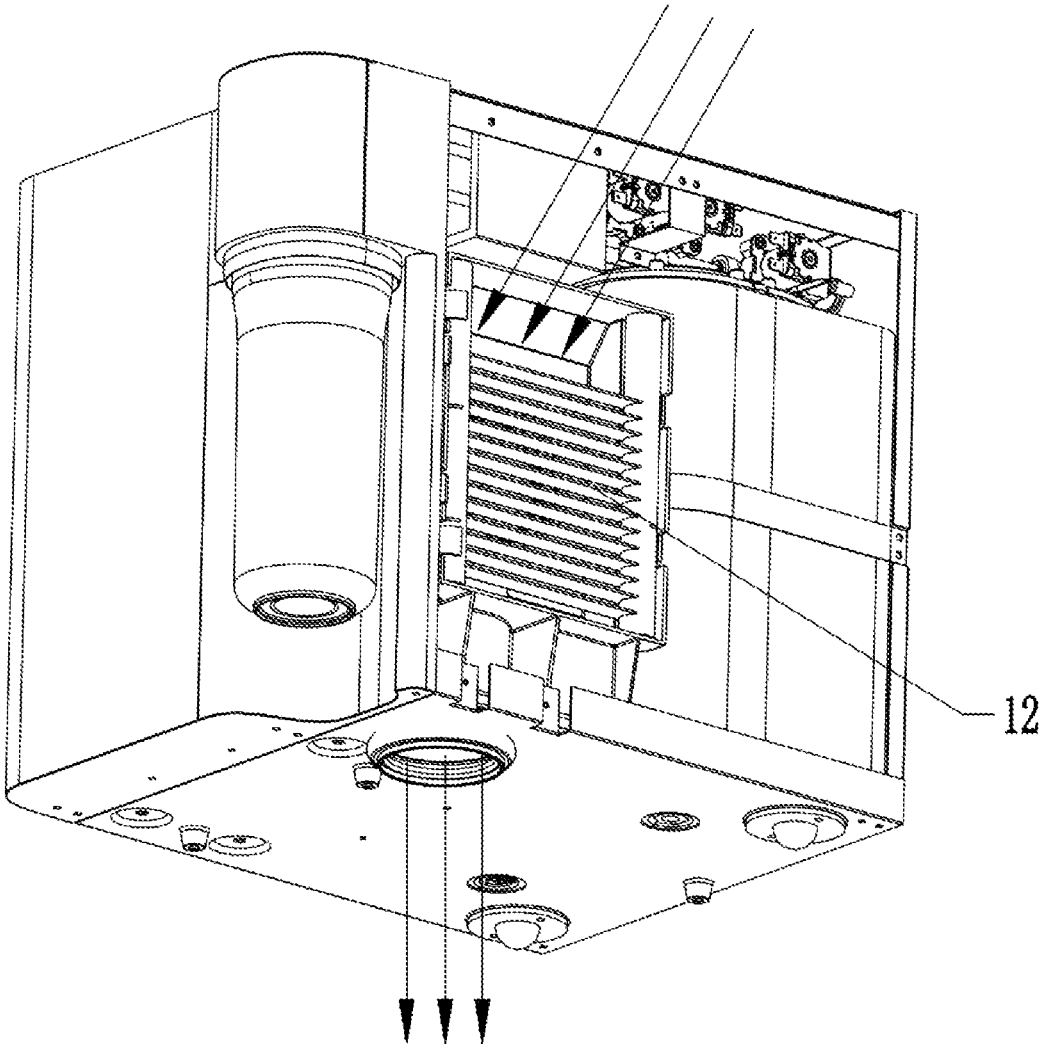
FIG. 4 is a schematic diagram of the water output device in another direction according to one embodiment of the present disclosure.
Figure 5:
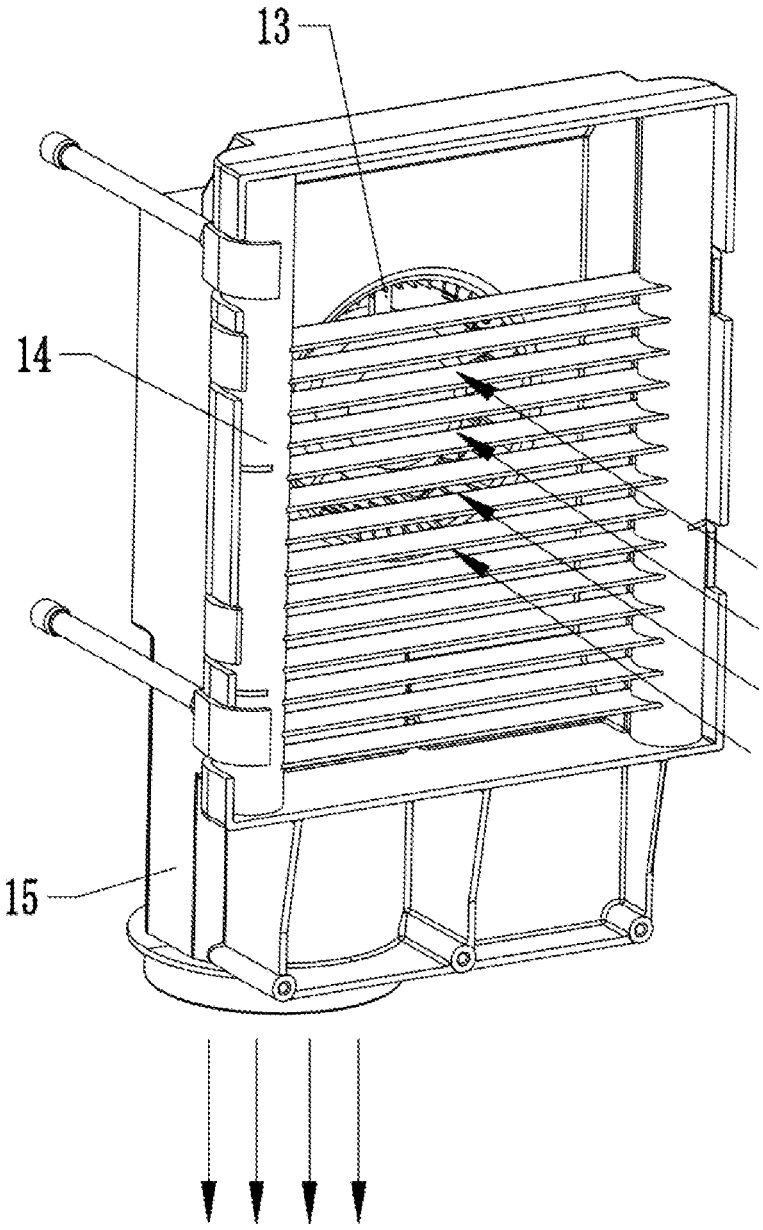
FIG. 5 is a schematic diagram of the heat dissipation mechanism according to one embodiment of the present disclosure.

As shown in FIGS. 4-5, in this embodiment, the water output device at least comprises a heat dissipation mechanism 12 for cooling the refrigeration mechanism 4. The heat dissipation mechanism 12 comprises a fan 13, a condenser 14 and a heat exhaust pipe 15. The fan 13 faces the refrigeration mechanism 4 and is attached to a side surface of the housing mechanism 1. The heat exhaust pipe 15 faces the fan 13 and is extended to a bottom of the housing mechanism 1. In this embodiment, the fan 13 can drawn in the side cold air to cool the refrigeration mechanism 4, the generated hot air can be discharged to the bottom of the housing mechanism ml through the heat exhaust pipe 15. The above-mentioned heat dissipation mechanism 12 has a reasonable cooling air channel, which will not cause the problem that the hot air is repeatedly redrawn. Additionally, the condenser 14 is available in the prior art and will not be repeated here.

Figure 3:
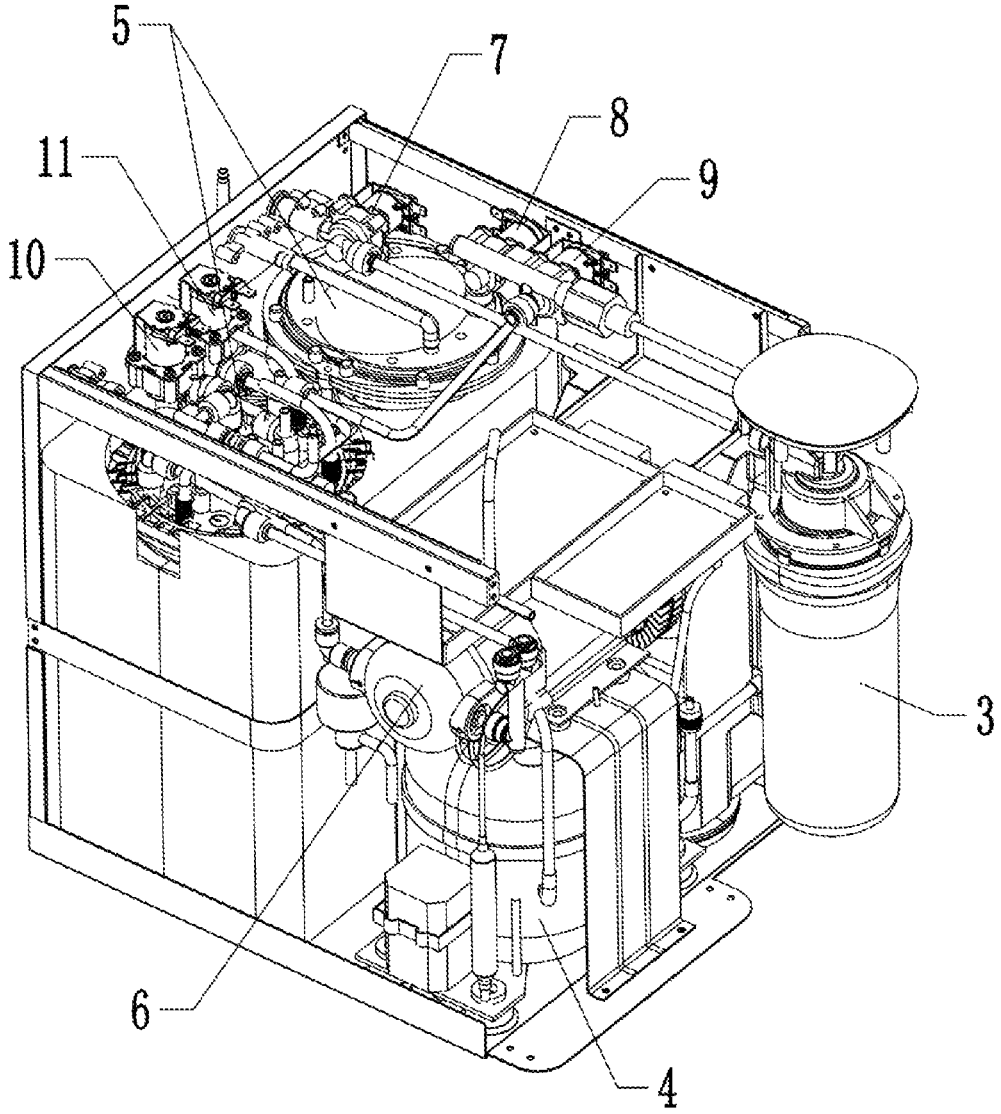
FIG. 3 is a schematic diagram of the water output device with part of the housing being removed according to one embodiment of the present disclosure.
Figure 10:
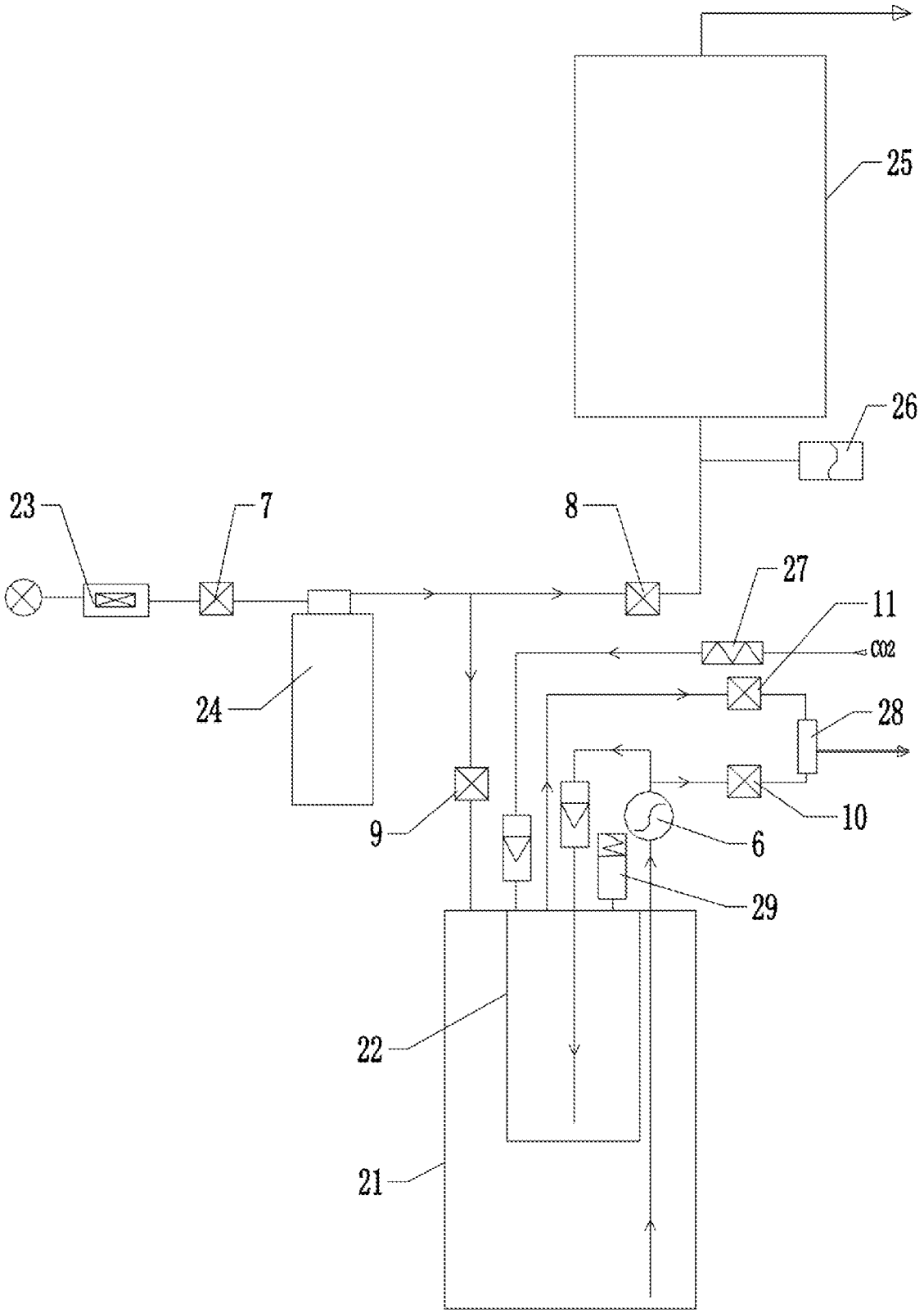
FIG. 10 is a schematic diagram showing the water path of the water output device according to one embodiment of the present disclosure.

As shown in FIGS. 3 and 10, in this embodiment, the water output device comprises a first solenoid valve 7 arranged at an inlet end of the water purifier 24, a second solenoid valve 8 arranged between the water purifier 24 and the hot water tank 25, a third solenoid valve 9 arranged between the water purifier 24 and the ice water tank 21, a fourth solenoid valve 10 arranged on the water output pipeline of the ice water tank 21, and a fifth solenoid valve 11 arranged on the water output pipeline of the soda water tank 22.

Additionally, it is to be noted that, as shown in FIG. 1, the water output device further comprises a control mechanism 2. The control mechanism 2 comprises a control assembly (not shown) and a display assembly. The display assembly is located on the housing mechanism 1. The first solenoid valve 7, the second solenoid valve 8, the third solenoid valve 9, the fourth solenoid valve 10 and the fifth solenoid valve 11 are electrically connected to the control mechanism 2, respectively. The control mechanism 2 is configure for controlling the on or off of respective solenoid valves to output the corresponding ice water, soda water or hot water. The first solenoid valve 7 is configured for controlling the outside water to the purifier 24. The second solenoid valve 8 is configured for controlling the water from the water purifier 24 to the hot water tank 25. The third solenoid valve 9 is configured for controlling toe water from the water purifier 24 to the ice water tank 21. The fourth solenoid valve 10 is configured for controlling the water from ice water tank 21 to outside. The fifth solenoid valve 11 is configured for the water from the soda water tank 22 to outside. The technology of control mechanism 2 controlling the on/off of valves is available in the prior art and will not be repeated here.

As shown in FIG. 10, a flow sensor 23 is located at the inlet end of the water purification mechanism 3. The first tank mechanism 17 comprises an expansion valve 26 in communication with the hot water tank 25. The second tank mechanism 18 comprises a safety valve 29 in communication with the soda water tank 22. The air inlet pipeline comprises a first balancing valve 27, and the water output pipeline comprises a second balancing valve 28. The expansion valve 26 and the safety valve 29 are used to protect the hot water tank 25 and the soda water tank 22, respectively. The flow sensor 23, the expansion 26, the safety valve 29 and the balancing valve are available in the prior and will not be repeated here.

By the embodiments described, the ice water tank 21 and the hot water tank 25 in the present disclosure are independent of each other while the soda water tank 22 is located within the ice water tank 21, therefore the size of the device can be effectively controlled. Additionally, the ice water tank 21, hot water tank 25 and the soda water tank 22 are separate tanks, and users are able to obtain pure ice water or pure soda water. Additionally, when the refrigeration mechanism 4 is cooling the water within the ice water tank 21, the soda water tank 22 can be cooled at the same. This is an improvement for energy use.

The above is only the preferred embodiments of the present disclosure and is not intended to limit the present invention. For those skilled in the art, the present invention may have various modifications and changes. Any modification, equivalent replacement, improvement and the like within the spirit and principle of the present disclosure shall be included in the scope of the present invention.

What is claimed is:

1. A water output device, comprising:

a housing mechanism (1);

a water purification mechanism (3), which comprises a water purifier (24) located within the housing mechanism (1);

a refrigeration mechanism (4), which comprises a compressor located within the housing mechanism (1);

a tank assembly (5), which comprises a first tank mechanism (17) configured for providing hot water, and second tank mechanism (18) configured for providing ice water and soda water;

the first tank mechanism (17) comprises a hot water tank (25) in communication with the water purifier (24); the second tank mechanism (18) comprises an ice water tank (21) in communication with the water purifier (24), a soda water tank (22) located within the ice water tank (21), a water pump (6) in communication with the ice water tank (21) and the soda water tank (22) respectively, and a cooling pipe (20) spirally extended into the ice water tank (21);

wherein the cooling pipe (20) is connected to the compressor; the ice water tank (21) comprises an air inlet pipeline for passing carbon dioxide gas; the hot water tank (25), the ice water tank (21), and the soda water tank (22) comprises water output pipelines, respectively;

the water pump (6) is configured for drawing the water from the ice water tank (21) into the soda water tank (22);

wherein the air inlet pipeline comprises a first balancing valve (27), and the water output pipeline comprises a second balancing valve (28).

2. The water output device according to claim 1, wherein the water output device at least comprises a heat dissipation mechanism (12) for cooling the refrigeration mechanism (4);

the heat dissipation mechanism (12) comprises a fan (13), a condenser (14), and a heat exhaust pipe (15); the fan (13) is facing the refrigeration mechanism (4), and is attached to a side surface of the housing mechanism (1); the heat exhaust pipe (15) faces the fan (13) and leads to a bottom surface of the fan (13) an leads to a bottom surface of the housing mechanism (1).

3. The water output device according to claim 1, wherein the water tank assembly (5) comprises a seat (16), and a heat insulation element (19) with 8-shaped located within the seat (16); the hot water tank (25) and the ice water tank (21) are arranged within the seat (16), respectively, and located in the heat insulation element (19).

4. The water output device according to claim 1, wherein the seat (16) is a two-piece structure which can be disassembled.

5. The water output device according to claim 1, wherein the cooling pipe (20) is spirally wound around the soda water tank (22).

6. The water output device according to claim 1, wherein the first tank mechanism (17) comprises an expansion valve (26) in communication with the hot water tank (25); the second tank mechanism (18) comprises a safety valve (29) in communication with the soda water tank (22).

7. The water output device according to claim 1, wherein the water output device comprises a first solenoid valve (7) arranged at an inlet end of the water purifier, a second solenoid valve (8) arranged between the water purifier and the hot water tank (25), a third solenoid valve (9) arranged between the water purifier and the ice water tank (21), a fourth solenoid valve (10) arranged on the water output pipeline of the ice water tank (21), and a fifth solenoid valve (11) arranged on the water output pipeline of the soda water tank (22).

* * * * *